US012781602B2

(12) United States Patent
Wrighton

(10) Patent No.: US 12,781,602 B2
(45) Date of Patent: Nov. 3, 2026

(54) ELECTRICAL SUBMERSIBLE PUMPING SYSTEM (ESP) MOTOR OIL SLINGER

(71) Applicant: SAUDI ARABIAN OIL COMPANY, Dhahran (SA)

(72) Inventor: Christopher Wrighton, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 913 days.

(21) Appl. No.: 17/823,405

(22) Filed: Aug. 30, 2022

(65) Prior Publication Data

US 2024/0068338 A1 Feb. 29, 2024

(51) Int. Cl.

| | |
|---|---|
| ***E21B 43/12*** | (2006.01) |
| ***F04D 13/10*** | (2006.01) |
| ***F04D 29/06*** | (2006.01) |
| ***F04D 29/58*** | (2006.01) |

(52) U.S. Cl.

CPC ..... *E21B 43/128* (2013.01); *F04D 13/10* (2013.01); *F04D 29/061* (2013.01); *F04D 29/5806* (2013.01)

(58) Field of Classification Search

CPC ..... B33Y 80/00; E21B 43/128; F04D 13/10; F04D 29/061; F04D 29/5806; F16N 2210/16; F16N 2210/28; F16N 7/363; H02K 7/003; H02K 9/19

See application file for complete search history.

(56) References Cited

U.S. PATENT DOCUMENTS

| | | | | |
|---|---|---|---|---|
| 4,565,937 | A | 1/1986 | Uhen | |
| 4,684,331 | A | 8/1987 | LaGrange et al. | |
| 5,201,848 | A * | 4/1993 | Powers | F04D 29/0416 415/199.1 |
| 9,790,950 | B2 | 10/2017 | Uneura et al. | |
| 10,738,654 | B2 | 8/2020 | Pikovsky et al. | |
| 10,794,466 | B2 | 10/2020 | Nishida et al. | |

(Continued)

FOREIGN PATENT DOCUMENTS

| | | | |
|---|---|---|---|
| CN | 211175031 | U | 8/2020 |
| CN | 216162491 | U | 4/2022 |
| DE | 102010017864 | A1 | 10/2011 |

OTHER PUBLICATIONS

Dr. Sastry Kandukuru et al.; "Additive Manufacturing For Marine Parts, A Market Feasability Study with Singapore Perspective", JIP in partnership with MPA, SSA and NAMIC; Report No. 2019-9172P, Document No. 11EMDQ19-1; Oct. 30, 2019; pp. 1-40 (40 pages).

(Continued)

*Primary Examiner* — Christopher M Koehler
*Assistant Examiner* — Ethan Nguyen Vo
(74) *Attorney, Agent, or Firm* — Osha Bergman Watanabe & Burton LLP

(57) ABSTRACT

An oil slinger apparatus includes a metal disc having a center annulus and an outer annulus disposed on a motor. The center annulus comprises a space between an inner diameter and an outer diameter with at least one feed hole in the space. The oil slinger apparatus includes an impeller imprint on the outer annulus with a vane around each of the at least one feed hole; and a keyway disposed on the metal disc configured to fit a key for aligning the oil slinger to the motor.

6 Claims, 5 Drawing Sheets

(56) References Cited

U.S. PATENT DOCUMENTS

| | | | | |
|---|---|---|---|---|
| 11,095,191 | B2 * | 8/2021 | Wrighton | H02K 7/083 |
| 2002/0141862 | A1 | 10/2002 | McEwen | |
| 2005/0269885 | A1 * | 12/2005 | Knox | F04D 29/061 310/90 |
| 2007/0295557 | A1 * | 12/2007 | Aldridge | F16H 57/0427 184/13.1 |
| 2013/0039782 | A1 * | 2/2013 | Brown | F04D 29/445 417/313 |
| 2015/0337716 | A1 * | 11/2015 | Ouwenga | F04C 29/028 417/364 |
| 2018/0141127 | A1 | 5/2018 | Richard | |
| 2018/0371929 | A1 | 12/2018 | Amador et al. | |
| 2020/0238384 | A1 | 7/2020 | Breindl et al. | |
| 2022/0163047 | A1 * | 5/2022 | Brogelli | F01D 5/02 |
| 2022/0397024 | A1 * | 12/2022 | Cheah | F04D 13/10 |
| 2023/0108948 | A1 * | 4/2023 | Brown | F04D 29/22 166/369 |
| 2024/0322624 | A1 * | 9/2024 | Takahata | H02K 9/19 |

OTHER PUBLICATIONS

International Search Report and Written Opinion issued in Application No. PCT/US2023/031505, mailed on Dec. 20, 2023 (21 pages).

* cited by examiner

ELECTRICAL SUBMERSIBLE PUMPING SYSTEM (ESP) MOTOR OIL SLINGER

BACKGROUND

In hydrocarbon well development, it is common practice to use electrical submersible pumping systems (ESPs) as a primary form of artificial lift. A challenge with ESP operations is dielectric oil circulation for cooling and lubrication in an ESP motor. In order to extend ESP run life and reduce the need to replace the ESP equipment, an oil slinger is installed in the motor to deflect oil from one end of a rotor assembly and into a stator/rotor cavity where it makes its way back to the other end of the rotor assembly before re-entering the inside of a shaft.

A typical industry oil slinger found in ESP motors is a simple disc with holes drilled diametrically into a center clearance annulus. The oil slinger is positioned on the shaft to align with the matching holes on the shaft. The drilled holes in the oil slinger can diminish dielectric oil circulation. 3D printing the oil slinger allows a variety of complex geometric shapes to be produced simply and quickly. A 3D printed oil slinger allows the design to be retro fitted to any ESP motor. The design may include an impeller imprint to replace the drilled holes, offering improved dielectric oil circulation at oil cost. The impeller design allows for oil deflection to be directed at any angle within a 180-degree arc.

In addition, the 3D printed oil slinger may offer higher quality, smoother surface finish, lower drag for more elaborate designs, and lower cost. The 3D printed oil slinger may improve dielectric oil circulation around the rotor cavity of the motor, motor cooling and bearing lubrication, and the total cost of ownership. The typical oil slinger known in the industry does not allow the full benefit of radial and tangential forces. The radial and tangential forces accelerate the dielectric oil into the stator/rotor cavity, which means bearing lubrication and motor cooling are at low efficiency. Accordingly, there exists a need for a way to match with a particular ESP manufacturer's shaft designs and direct oil deflection.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an oil slinger apparatus comprising: a metal disc having a center annulus and an outer annulus disposed on a motor, wherein the center annulus comprises a space between an inner diameter and an outer diameter with at least one feed hole in the space; an impeller imprint on the outer annulus with a vane around each of the at least one feed hole; and a keyway disposed on the metal disc configured to fit a key for aligning the oil slinger to the motor.

In one aspect, embodiments disclosed herein relate to a method for lubrication and cooling, the method comprising: designing an oil slinger to fit in a motor; 3D printing the oil slinger with at least one feed hole and a vane for each of the at least one feed hole; aligning the oil slinger with a shaft in the motor, via a keyway; installing the oil slinger; running the motor on a pump; flowing oil from the shaft into the oil slinger; deflecting and slinging oil, via the oil slinger, in any direction via the vane to an end of a rotor assembly; lubricating a plurality of bearings and cooling a plurality of rotors in the rotor assembly; and flowing oil back into the motor and the shaft.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
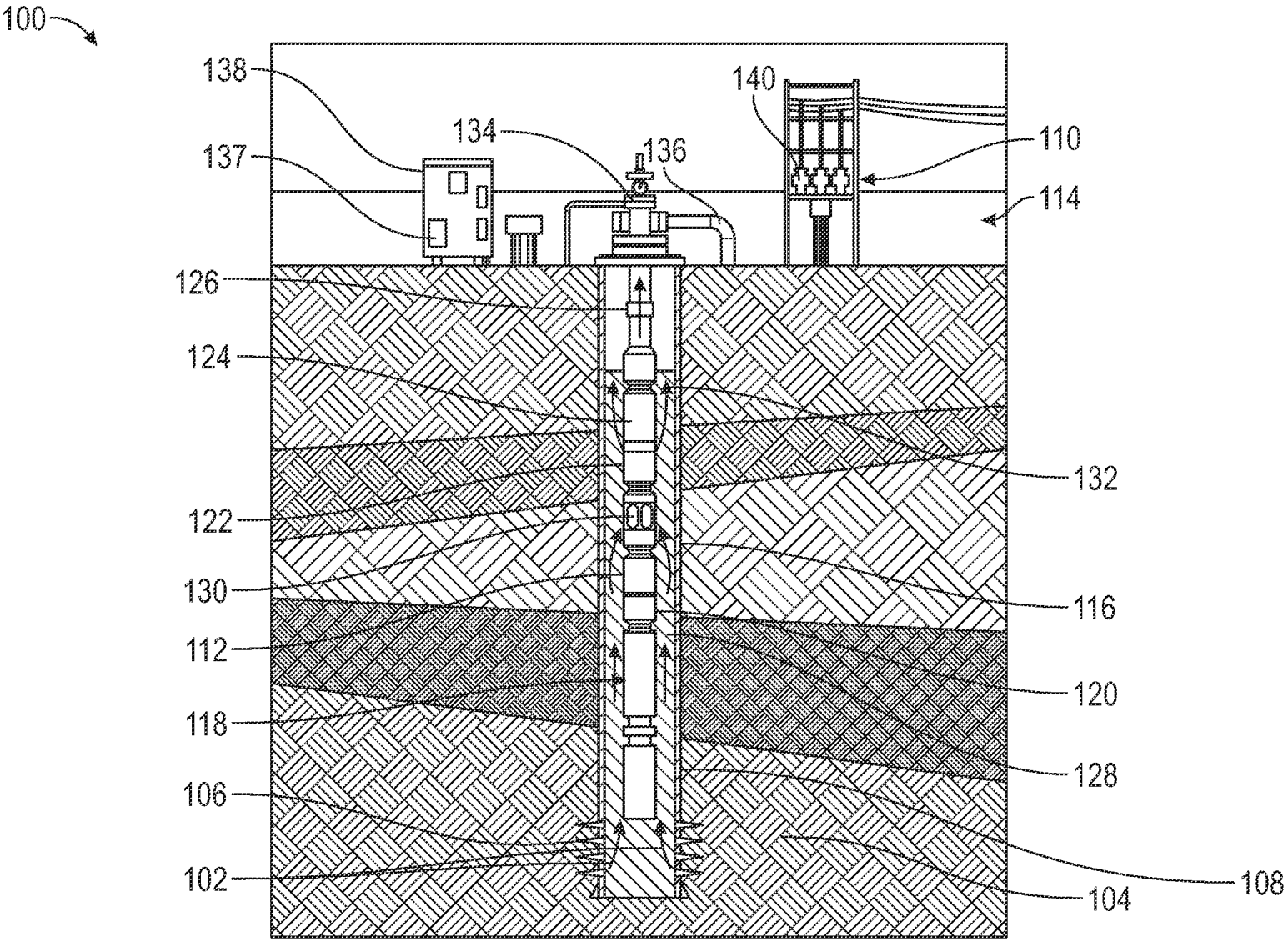
FIG. 1 shows an exemplary well with an Electrical Submersible Pump (ESP) completion design in accordance with one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

FIG. 1 shows an exemplary Electrical Submersible Pump (ESP) system (100). The ESP system (100) is one example of an artificial lift system that is used to help produce fluids (102) from a formation (104). Perforations (106) in the well's (116) casing string (108) provide a conduit for the produced fluids (102) to enter the well (116) from the formation (104). An ESP system (100) is an example of the artificial lift system, ESP system and artificial lift system may be used interchangeably within this disclosure. The ESP system (100) includes surface equipment (110) and an ESP string (112). The ESP string (112) is deployed in a well (16) and the surface equipment (110) is located on the surface (114). The surface (114) is any location outside of the well (116), such as the Earth's surface.

The ESP string (112) may include a motor (118), motor protectors (120), a gas separator (122), a multi-stage centrifugal pump (124) (herein called a "pump" (124)), and an electrical cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface (114). The motor (118) is cooled by the produced fluids (102) passing over the motor housing. The motor (118) is powered by the electrical cable (126). The electrical cable (126) may also provide power to downhole pressure sensors or onboard electronics that may be used for communication. The electrical cable (126) is an electrically conductive cable that is capable of transferring information. The electrical cable (126) transfers energy from the surface equipment (110) to the motor (118). The electrical cable (126) may be a three-phase electric cable that is specially designed for downhole environments. The electrical cable (126) may be clamped to the ESP string (112) in order to limit electrical cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) are located above (i.e., closer to the surface (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing string (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface (114).

In other embodiments, sensors may be installed in various locations along the ESP string (112) to gather downhole data such as pump intake volumes, discharge pressures, shaft speeds and positions, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface (114), the produced fluids (102) flow through the wellhead (134) into production equipment (136). The production equipment (136) may be any equipment that can gather or transport the produced fluids (102) such as a pipeline or a tank.

The remainder of the ESP system (100) includes various surface equipment (110) such as electric drives (137), production controller (138), the control module, and an electric power supply (140). The electric power supply (140) provides energy to the motor (118) through the electrical cable (126). The electric power supply (140) may be a commercial power distribution system or a portable power source such as a generator. The production controller (138) is made up of an assortment of intelligent unit-programmable controllers and drives which maintain the proper flow of electricity to the motor (118) such as fixed-frequency switchboards, soft-start controllers, and variable speed controllers. The production controller (138) may be a variable speed drive (VSD), well choke, inflow control valve, and/or sliding sleeves. The production controller (138) is configured to perform automatic well operation adjustments. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

Figure 2:
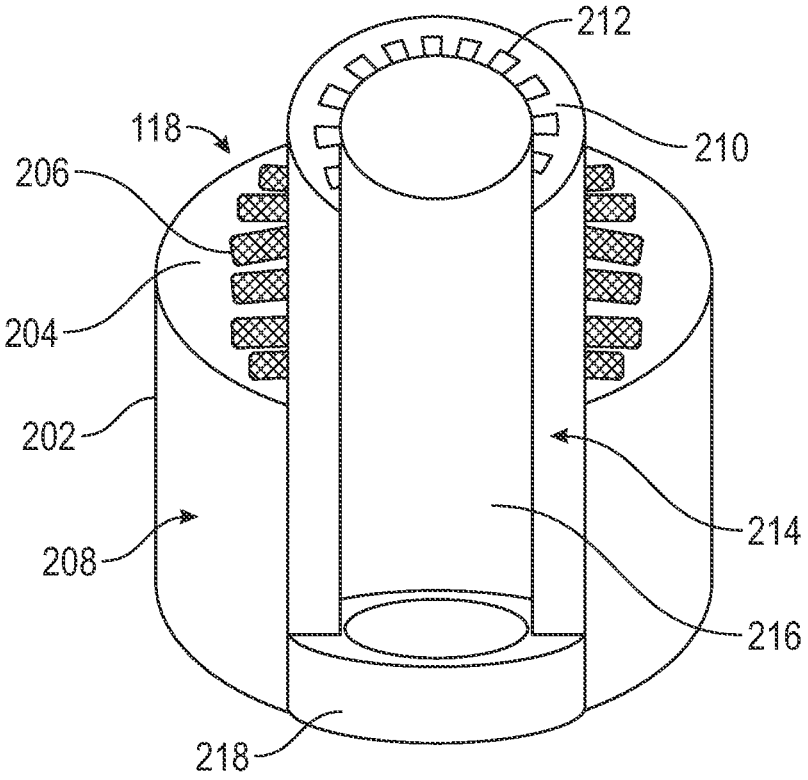
FIG. 2 is a schematic illustration of an embodiment of an ESP motor useful in conjunction with the well depicted in FIG. 1.

FIG. 2 is a schematic illustration of an embodiment of the motor (118) useful in conjunction with the well (116) depicted in FIG. 1. The motor (118) rotates and may contain multiple grades of dielectric oil. Dielectric oil is commonly known for lubrication, insulation, and for homogeneous distribution of heat. The motor (118) may include one or more components including but not limited to a stator (202), rotor (210), shaft (216), and bearing (218). The stator (202) may be a core or electrical field of the motor (118). The stator (202) may be composed of a stator core (204), stator windings (206), and housing material for the desired diameter. Housing material may form the cover for the motor (118) and may be chosen dependent upon environment. The stator core (204) may include stator laminations (208)

stacked under pressure. Stator laminations (208) may be thin sheets of a material such as die-punched steel or bronze. The stator laminations (208) are commonly used around the stator core (204) for insulation. The stator windings (206) may provide magnetizing winding wound through the slots in the stator core (204). The stator windings (206) may be made of a Polyimide material.

The rotor (210) may be a device that rotates inside of the stator core (204). The rotor may include rotor bars (212) and rotor lamination (214). Rotor bars (212) may be of bar shape, round shape, or tombstone shape. The rotor bar (212) shape and placement may be critical in producing horsepower. Rotor bars (212) may provide current path to build an induced magnetic field. The rotor bars (212) may be of copper material to provide field strength. The rotor lamination (214) may be of smaller size than the stator laminations (208). The rotor lamination (214) may create an iron core. The shaft (216) may be a central component of the motor (118). The shaft (216) may be of cylindrical shape. The shaft (216) may be hollow. The shaft (216) may be a rotor shaft or a stator shaft. One or more rotors (210) and a shaft (216) may make up a rotor assembly in the motor (118).

The bearing (218) may centralize the rotor (210) within the cavity of the stator (202). The bearing (218) may create friction and generate heat. The bearing (218) may contain fluid holes to insure oil circulation and wide-angle oil grooves on the outer diameter. The fluid holes and grooves may provide evenly distributed lubrication over the bearing (218). The motor (118) may include a variety of bearing types including but not limited to rotor bearings (218) and motor thrust bearings. Those skilled in the art might appreciate that the bearing (218) may have insulation. The insulation may prevent circulating rotor (210) currents which may damage the bearing (218).

Figure 3:
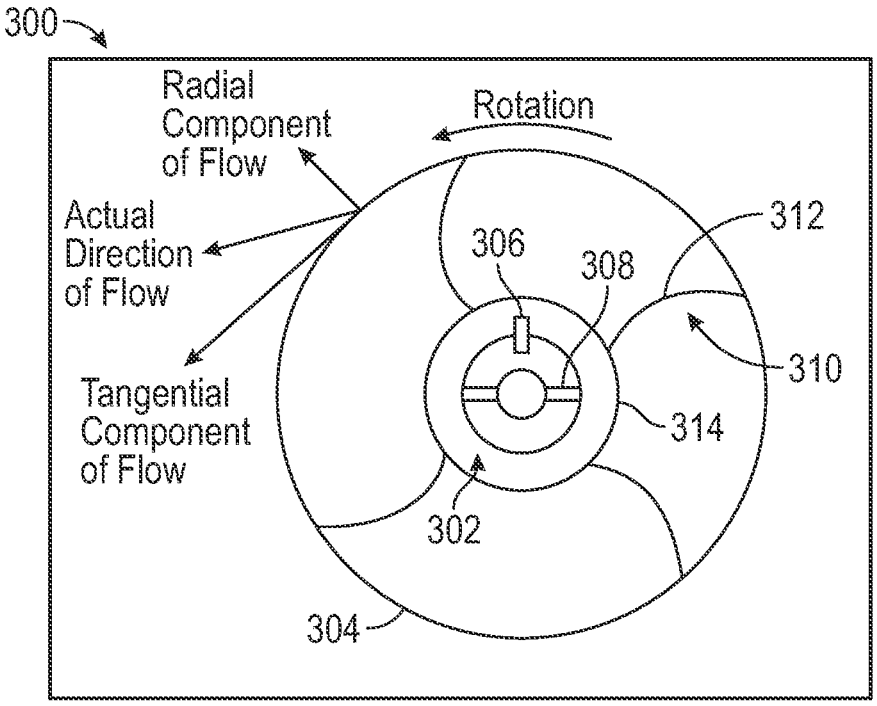
FIG. 3 is a schematic illustration of an embodiment of a 3D printed oil slinger useful in conjunction with the well depicted in FIG. 1.

FIG. 3 is a schematic illustration of an embodiment of a 3D printed oil slinger useful in conjunction with the well (116) depicted in FIG. 1. In one or more embodiments, the ESP system (100) includes an oil slinger (300) in the motor (118). The motor (118) may have a different shape and require the oil slinger (300) to be retrofitted. The oil slinger (300) is a metal disc disposed on the motor (118). The oil slinger (300) may have a center annulus (302) and an outer annulus (304). The center annulus (302) includes a space between the inner diameter and the outer diameter of the center annulus (302). The center annulus (302) is aligned and locked in position on the shaft (216) with a key within the motor (118). The key may be an industry standard key for ESP motors (118). The key is used in a keyway (306) disposed on the oil slinger (300) and outside diameter of the shaft (216). The center annulus (302) has at least one feed hole (308) in the space utilized for communication between the inside of the hollow section of the shaft (216) to the outer portion of the shaft (216).

The feed hole (308) may allow for dielectric oil to be centrifuged. The dielectric oil may be centrifuged from inside the hollow section of the shaft (216) and into an annular groove (310) via the at least two feed holes (308). The dielectric oil may then be centrifuged into the cavity of the stator (202) and rotor (210) via the oil slinger (300), whereupon dielectric oil may migrate along the length of the cavity lubricating bearings (218) and cooling motors (210). The dielectric oil may follow the full length of the cavity before it re-enters another end of the rotor shaft (216) to travel back towards any oil slinger (300) cross-drilled hole. The cross-drilled hole may be a feed hole (308). The oil slinger (300) may include an impeller imprint (310). The impeller imprint (310) may be a vane (312) set around and open to the annular groove (302) with access to holes such as the feed holes (308). Specific to this embodiment, four vanes (312) are designed on the oil slinger (300). The impeller imprint (310) may be an impeller design indented on the oil slinger (300).

The annular groove (314) may be a rounded channel. The annular groove (314) may be around the center annulus (306). The vanes (312) may be equally spaced. The vanes (312) may be adjusted or designed to provide the most efficient profile to maximize the outlet flow for a given shaft (216) design. The vanes (312) may have a variety of thickness. The impeller imprint (310) of the vanes (312) may allow a fluid outlet to be directed left, right, or any angle within a 180-degree arc. As labeled in FIG. 3, those skilled in the art might appreciate reference to the result of flow exiting the oil slinger (300) may follow centrifugal impeller rules, where radial and tangential components of flow will combine to form the actual directions into the stator (202) and rotor (210) cavity. An example of rotation direction is shown in FIG. 3 illustrating the flow direction with radial and tangential components.

Figure 4A:
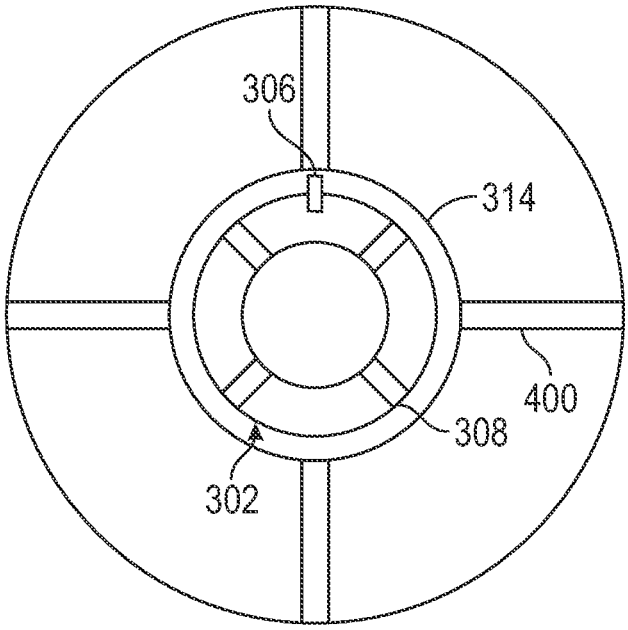
FIG. 4A-4C show schematic illustrations of multiple embodiments of an oil slinger useful in conjunction with the well depicted in FIG. 1.
Figure 4B:
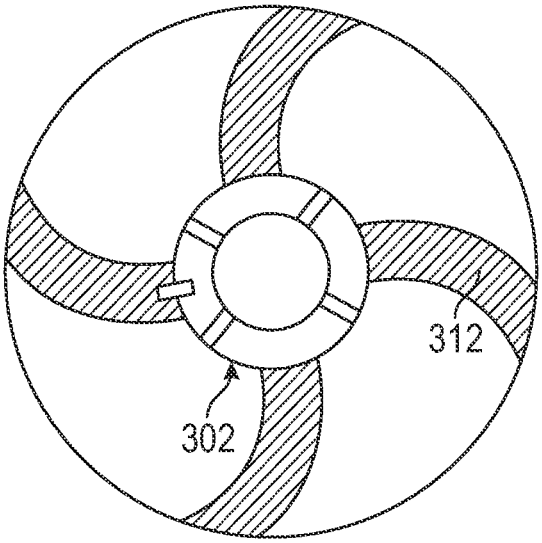
Figure 4C:
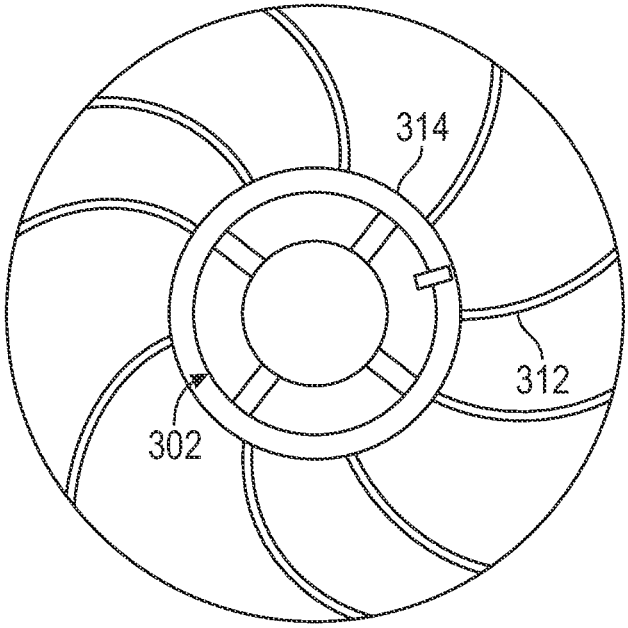

FIG. 4 shows a schematic illustration of multiple embodiments of an oil slinger useful in conjunction with the well depicted in FIG. 1. FIG. 4A-4C illustrates three options for an oil slinger (300) design. FIG. 4A shows a traditional/current oil slinger design. FIG. 4A illustrates one or more feed holes (308) inside the center annulus (302) from inside to outside of the hollow portion of the shaft (216) leading into the annular groove (314) on the oil slinger (300). Further, FIG. 4A illustrates four discharge holes (400) in the outer annulus (304) of the oil slinger (300). The discharge holes (400) may be industry standard of the traditional oil slinger design. FIG. 4B illustrates an embodiment of the 3D printed oil slinger (300) with four vanes (312) equally spaced around four feed holes (308) from the shaft (216). FIG. 4C illustrates an embodiment of the 3D printed oil slinger (300) with nine equally spaced vanes (312) around the annular groove (314) fed by the four feed holes (308) from the shaft (216).

Figure 5:
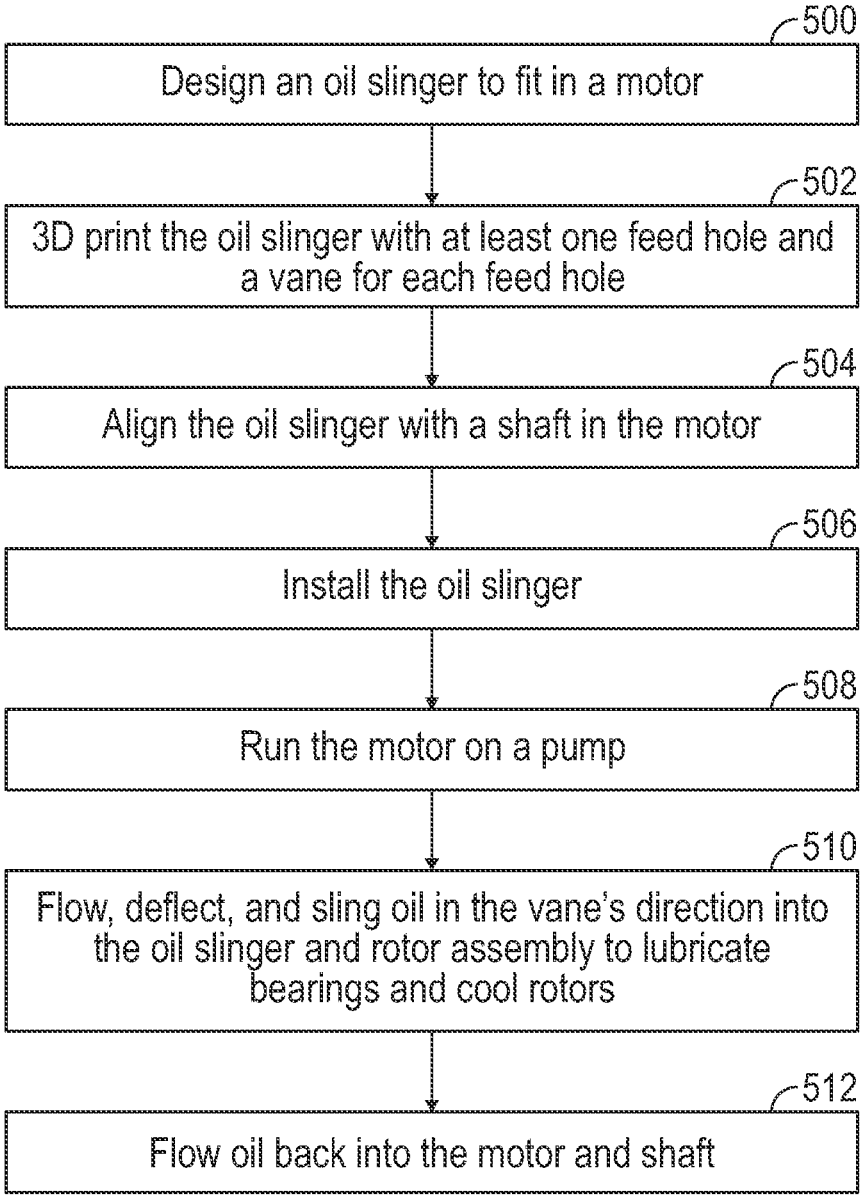
FIG. 5 is a flowchart in accordance with one or more embodiments.

FIG. 5 shows a flowchart in accordance with one or more embodiments. Specifically, FIG. 5 shows a method and apparatus for the 3D printed oil slinger (300). One or more blocks in FIG. 5 may be performed using one or more components as described in FIGS. 1 through 4. While the various blocks in FIG. 5 are presented and described sequentially, one of ordinary skill in the art will appreciate that some or all of the blocks may be executed in parallel and/or iteratively. Furthermore, the blocks may be performed actively or passively.

In Block 500, an oil slinger (300) is designed to fit in the motor (118). The motor (118) may be an ESP motor. In Block 502, the oil slinger (300) is 3D printed with at least one feed hole (302) and a vane (312) for each feed hole (302). The feed hole (302) may be into an annular groove (314) around the outer annulus (302) of the oil slinger (300). The annular groove (314) may feed into the vanes (312). The feed holes (308) may feed into the vanes (312) when there is no annular groove (314). The vane (308) for each feed hole (302) may be equally spaced. The vane (308) for each feed hole (302) may be around an annular groove (310). In Block 504, the oil slinger (300) is aligned with a shaft (216) in the motor (118). The feed holes (302) may fit onto the shaft (216) and be driven rotationally via a key on the shaft (216) through the keyway (306). The key may align the feed hole (308) into the vane (312) for designs without an annular groove (314). In Block 506, the oil slinger (300) is installed in the motor (118). In Block 508, the motor (118) is run on the pump (124). In Block 510, oil is flowed, deflected, and slung in the vane's (308) direction into the oil slinger (300) and rotor assembly to lubricate bearings (218) and cool rotors (210). Deflecting and slinging oil via the oil slinger (300) to an end of the rotor assembly may be directed via the vane (308). The vane's (308) direction may be any direction within a 180-degree arc. In Block 512, the oil flows back into the motor (118) and shaft (216). The oil slinger (300) may be designed to fit a new motor (118) or to be fitted for existing designs of any ESP motor (118).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. An oil slinger apparatus comprising:

a metal disc having a center annulus and an outer annulus disposed on a motor, wherein the center annulus comprises a space between an inner diameter and an outer diameter of the center annulus with at least one feed hole in the space;

an impeller imprint on the outer annulus with a vane around each of the at least one feed hole; and a keyway disposed on the metal disc configured to fit a key for aligning the oil slinger to the motor.

2. The oil slinger apparatus of claim 1, further comprising: an annular groove in the outer annulus of the metal disc.

3. The oil slinger apparatus of claim 1 wherein the metal disc is 3D printed.

4. The oil slinger apparatus of claim 1, wherein the motor is an Electrical Submersible Pump motor.

5. The oil slinger apparatus of claim 1, wherein the vane around each of the at least one feed hole is equally spaced.

6. The oil slinger apparatus of claim 1, wherein the center annulus aligns with a shaft on the motor.

* * * * *